US008905528B2

(12) United States Patent
Hochreiter

(10) Patent No.: US 8,905,528 B2
(45) Date of Patent: Dec. 9, 2014

(54) INK TANK WITH A COMPLIANT WICK

(75) Inventor: Eric Peschan Hochreiter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 108 days.

(21) Appl. No.: 13/556,449

(22) Filed: Jul. 24, 2012

(65) Prior Publication Data

US 2014/0028763 A1 Jan. 30, 2014

(51) Int. Cl.
*B41J 2/175* (2006.01)

(52) U.S. Cl.
USPC ..... 347/86; 347/93

(58) Field of Classification Search
CPC ..... B41J 2/17513
USPC ..... 347/9, 84, 85, 92, 93, 86
See application file for complete search history.

(56) References Cited

U.S. PATENT DOCUMENTS

| | | | | |
|---|---|---|---|---|
| 4,757,331 | A * | 7/1988 | Mizusawa | 347/85 |
| 5,477,963 | A * | 12/1995 | Mochizuki et al. | 206/701 |
| 5,719,609 | A | 2/1998 | Hauck et al. | |
| 5,949,458 | A * | 9/1999 | Studholme | 347/86 |
| 6,039,441 | A * | 3/2000 | Tomikawa et al. | 347/86 |
| 6,361,159 | B1 * | 3/2002 | Chino | 347/86 |
| 6,409,325 | B1 * | 6/2002 | Matsumoto et al. | 347/87 |
| 6,460,984 | B1 * | 10/2002 | Matsumoto et al. | 347/86 |
| 6,578,947 | B1 * | 6/2003 | Suwabe et al. | 347/29 |
| 6,935,730 | B2 * | 8/2005 | Qingguo et al. | 347/86 |
| 7,246,873 | B2 * | 7/2007 | Tsuchii | 347/22 |
| 7,695,125 | B2 * | 4/2010 | Silverbrook et al. | 347/85 |
| 8,132,904 | B2 * | 3/2012 | Anderson et al. | 347/93 |
| 2002/0021339 | A1 * | 2/2002 | Higuma et al. | 347/86 |
| 2002/0149646 | A1 * | 10/2002 | Pawlowski et al. | 347/50 |
| 2002/0167575 | A1 * | 11/2002 | Kitabatake et al. | 347/86 |
| 2003/0016279 | A1 * | 1/2003 | Hayashi et al. | 347/87 |
| 2003/0052951 | A1 * | 3/2003 | Ujita et al. | 347/86 |
| 2003/0142178 | A1 * | 7/2003 | McKinnell et al. | 347/86 |
| 2004/0090503 | A1 | 5/2004 | Kotaki et al. | |
| 2006/0132561 | A1 * | 6/2006 | Anderson et al. | 347/86 |
| 2006/0209144 | A1 * | 9/2006 | Rosa | 347/86 |
| 2007/0206074 | A1 * | 9/2007 | Anderson et al. | 347/86 |
| 2008/0239037 | A1 * | 10/2008 | Inoue et al. | 347/86 |
| 2008/0303880 | A1 * | 12/2008 | Ujita | 347/86 |
| 2009/0040281 | A1 * | 2/2009 | Sulser | 347/86 |
| 2011/0096121 | A1 * | 4/2011 | Anderson et al. | 347/44 |
| 2011/0148999 | A1 * | 6/2011 | O'Leary et al. | 347/86 |
| 2012/0050429 | A1 * | 3/2012 | Kurobe | 347/93 |

* cited by examiner

*Primary Examiner* — Matthew Luu
*Assistant Examiner* — Patrick King
(74) *Attorney, Agent, or Firm* — Peyton C. Watkins

(57) ABSTRACT

An ink tank includes a body for retaining ink which body includes an outlet hole for permitting ink to pass from the reservoir body; a flange portion surrounding the outlet hole; a filter affixed to a periphery of the outlet hole that prevents ink transfer below a predetermined fluid pressure; and at least a first wick positioned in the flange portion and having fibers that are oriented in a direction perpendicular or substantially perpendicular to ink flow out of the outlet hole which permits transfer of ink while having a predetermined insertion force at or below a predetermined force during an insertion process of the ink tank.

9 Claims, 5 Drawing Sheets

INK TANK WITH A COMPLIANT WICK

FIELD OF THE INVENTION

The present invention generally relates to ink tanks having a flange that contains a wick and more particularly to ink tanks that have at least one wick that is constructed and disposed in the flange in such a manner that the ink tanks are installed with a force that users expect so that they are not misled into perceiving problems that do not exist.

BACKGROUND OF THE INVENTION

Inkjet printing systems can be either an on-axis or off-axis printer. In on-axis printing, printheads include inlet ports for receiving ink from one or more ink tanks. The printhead includes arrays of drop ejectors that receive the ink from the inlet ports and that are controlled to make marks of particular sizes, colors, or densities in particular locations on the recording medium in order to print the desired image. In some types of inkjet printing systems the array(s) of dot forming elements extends across the width of the page, and the image can be printed one line at a time, as the recording medium is moved relative to the printhead. Alternatively, in a carriage printing system (whether for desktop printers, large area plotters, etc.) the printhead or printheads are mounted on a carriage that is moved past the recording medium in a carriage scan direction as the dot forming elements are actuated to make a swath of dots. At the end of the swath, the carriage is stopped, printing is temporarily halted and the recording medium is advanced. Then another swath is printed, so that the image is formed swath by swath.

An inkjet drop ejector includes a nozzle and a drop forming mechanism (such as a resistive heater for thermal inkjet, or a piezoelectric device for piezoelectric inkjet) in order to generate pressure within an ink-filled chamber and eject ink from the nozzle. In page-width inkjet printers as well as in carriage inkjet printers, the printhead and the recording medium are moved relative to one another as drops are ejected in order to form the image.

An ink supply can be permanently attached to a printhead, or an ink supply can be replaceably connected to and disconnected from the printhead. Unlike permanently attached ink supplies, the printhead does not need to be discarded for a replaceable ink supply when the ink supply is depleted, so the running costs of the printer are lower for replaceable ink supplies. Ink tanks containing ink are installed into the printhead for supplying the ink needed for printing. Some types of ink tanks include an outlet port having a flange that contains a wick for permitting ink to pass to an inlet port of the printhead by capillary action. The inks tanks are manually mounted into the printhead by a pivoting, inwardly and downwardly manual force of the user.

In an off-axis printing system, the printhead is substantially similar except that there is a primary ink supply and a secondary ink supply that are connected for supplying the ink for printing. The primary ink supply is rigidly mounted on the printer so that it remains stationary, and a secondary ink supply is mounted on the carriage. Ink is transferred from the primary ink supply to the secondary ink supply as needed. In this way, the amount of ink that is moved by the carriage is kept low (so that forces during carriage acceleration and deceleration can be acceptably low) and the user does not need to replace the ink very frequently.

To refill the secondary ink supply from the primary ink supply, flexible tubing is used, or alternatively the secondary ink supply can be moved near the primary ink supply on an as-needed basis and ink can be transferred to the secondary ink supply. Similar to the on-axis ink tanks, some types of secondary ink supplies include an outlet port having a flange that contains a wick that facilitates ink transfer to the printhead. A replaceable secondary ink supply for an off-axis printing system will be referred to herein as an ink tank, i.e. the same terminology used for the replaceable ink supply for an on-axis printing system.

In both on-axis and off-axis printing systems having replaceable ink supplies, the ink tanks (secondary ink supply for the off-axis) need to be installed. In both cases and particularly for the off-axis printing system, the ink tank can even need to be removed and replaced for maintenance. In both cases, the user needs a user-friendly process of installing the ink tanks which does not present the perception that the installation is malfunctioning due to an unexpected excessive force that is needed to install the tanks when, in fact, the tanks are being properly installed.

Consequently, a need exists for inks tanks that are comfortably installed so that the user is not misled into perceiving problems that do not actually exist.

SUMMARY OF THE INVENTION

The present invention is directed to overcoming one or more of the problems set forth above. Briefly summarized, according to one aspect of the invention, the invention resides in an ink tank comprising: a body for retaining ink which body includes an outlet hole for permitting ink to pass from the reservoir body; a flange portion surrounding the outlet hole; a filter affixed to a periphery of the outlet hole that prevents ink transfer below a predetermined fluid pressure; and at least a first wick positioned in the flange portion and having fibers that are oriented in a direction perpendicular or substantially perpendicular to ink flow out of the outlet hole which permits transfer of ink while having a predetermined insertion force at or below a predetermined force during an insertion process of the ink tank.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures.

DETAILED DESCRIPTION OF THE INVENTION

As used herein, words such as "outwardly," "downwardly," "inwardly," "upwardly," and the like are words of convenience for the position shown in the particular figure, but as easily understood by those skilled in the art, such directional terms are altered when the particular orientation is correspondingly altered.

Figure 1:
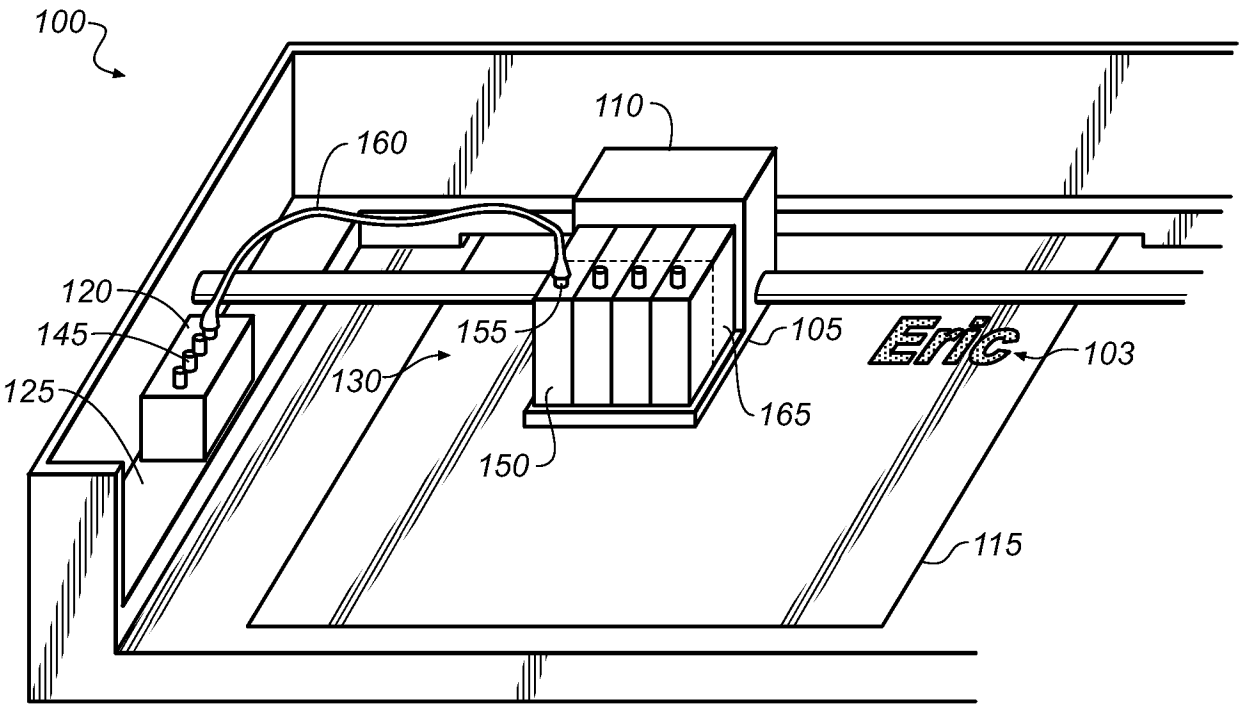
FIG. 1 is a perspective of an interior portion of an off-axis printer.

FIG. 1 is a perspective of an interior portion of an off-axis printer 100 according to an embodiment of the present invention. Although ink is shown in the preferred embodiment, any liquid is suitable for the present invention. An inkjet printhead 105 is disposed on a carriage 110 and includes at least one nozzle array (not visible from the view of FIG. 1) which directs ink droplets onto a recording medium 115. A primary ink supply 120 is rigidly mounted on a support base 125. The carriage 110 moves the printhead 105 back and forth across a print region 130 so that an image (such as letters "Eric" 103) can be printed on the recording medium 115. At least one pressure-regulated secondary ink supply 150 is mounted on the printhead 105 which moves in conjunction with the printhead 105. In this embodiment of FIG. 1, the primary ink supply 120 includes four ink sources, each having a tubing connector 145, although the number of ink sources can vary depending on the particular design. The tubing connectors 145 extend inside the primary ink supplies 120 and can extend substantially to the bottom of primary ink supply 120 so that ink can continue to be withdrawn as it is depleted. Alternatively, in other configurations (not shown) tubing connectors 145 can be located near the bottom of primary ink supply 120, preferably when the primary ink supply 120 is located above a secondary ink supply 150 permitting gravity to transport the fluid. In the example of FIG. 1, a pump (not shown) is enclosed within the primary ink supply 120 for pumping the ink since the location of the primary ink supply 120 (at or below the elevation of its destination, secondary ink supplies 150) does not lend itself to gravitational flow.

Four secondary ink supplies 150 (e.g. cyan, magenta, yellow and black inks) each include a conduit 155 and are mounted on the carriage 110 via the printhead 105 for supplying ink to printhead 105 so that the carriage 110 moves the secondary ink supplies 150 as well as the printhead 105. As ink is used during printing and maintenance processes, ink is passed from the primary ink supply 120 through a flexible tubing 160, to the conduit 155 and eventually into the secondary ink supplies 150 for replenishing the secondary ink supplies 150. It is noted for clarity that only one piece of the flexible tubing 160 is shown in FIG. 1 so as not to obscure other features. Secondary ink supplies 150 can be provided as discrete ink supplies, or two or more ink supplies can be bundled together as a multi-chamber ink tank 250 (see FIG. 2).

A pressure regulator 165 is disposed extending into the secondary ink supply 150 for regulating the ink back pressure required by the ejector nozzles and in particular for damping out pressure spikes that occur as the carriage 110 is moved back and forth during printing.

Figure 2:
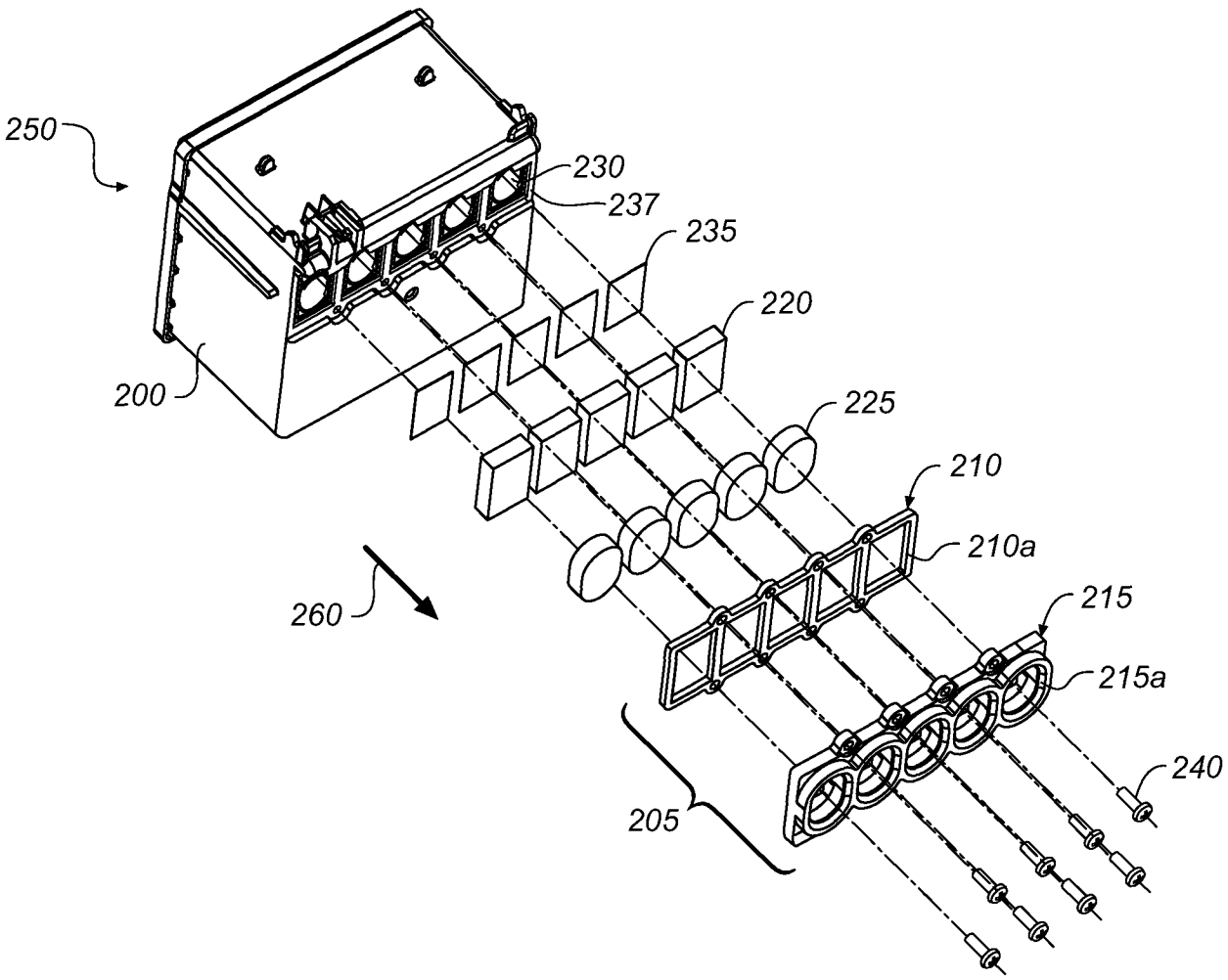
FIG. 2 is an exploded view of a multi-chamber ink tank according to an embodiment of the invention.

Referring to FIG. 2, there is shown an exploded view of the multi-chamber ink tank 250 of the present invention shown in an unassembled state for illustrating its details more clearly. The multi-chamber ink tank 250 includes a body 200 to which is attached a flange assembly 205 consisting of an inner gasket 210 and an outer frame 215. The inner gasket 210 includes a plurality of individual inner gasket units 210*a* each of which is rectangular shaped to conform to the shape of a rectangular shaped compliant wick 220 which is held within each inner gasket unit 210*a*. Inner gasket 210 also provides a seal between outer frame 215 and body 200. The outer frame 215 includes a plurality of individual outer frame units 215*a* each of which has round ends and straight sides shaped to conform to the shape of an oval or racetrack shaped interface wick 225 having round ends that is held within the outer frame unit 215*a*.

Compliant wick 220 is more compliant along a compression direction 260 than the interface wick 225. This is because the fibers in compliant wick 220 are oriented substantially perpendicular to the compression direction 260, while the fibers in interface wick 225 are oriented substantially parallel to compression direction 260. Compression direction 260 is the direction in which force is applied to the wicks when multi-chamber ink tank is installed in printhead 105. Interface wick 225 is formed by extruding with the fibers parallel to the extrusion direction. The shape of its periphery (e.g. a racetrack shape with round ends) is determined by the shape of the extrusion die, so that rounded periphery shapes can be readily fabricated. The interface wicks 225 are cut to length across the fibers with a straight cut. Compliant wicks 220 are formed by extruding with the fibers perpendicular to the extrusion direction. In this configuration it is preferred to form the compliant wick 220 with a rectangular periphery, cutting across the fibers with a straight cut. When assembling multi-chamber ink tank 250 it is advantageous to have different shapes for compliant wick 220 and interface wick 225 so that the proper wicks are assembled in the proper places.

A plurality of outlet holes 230 are disposed in a bottom surface of the body 200, and the plurality of individual flanges each respectively surround an outlet hole 230. A fine mesh filter 235 is affixed, for example by heat staking, to a raised edge around a periphery 237 of outlet hole 230 on a bottom surface of the body 200. Filter 235 prevents ink transfer from the body 200 to the compliant wick 220 and interface wick 225 at and below a predetermined fluid pressure, thereby keeping ink from flowing out of the outlet port when the multi-chamber ink tank 250 is removed from the printhead 105. It was found for an ink tank having a filter 235 affixed to the perimeter 237 of outlet hole 230 that if the compliant wick 220 is not included between filter 235 and an inlet port 420 (FIG. 4) of printhead 105, excessive force was required to install multi-chamber ink tank 250 into printhead 105. The flange assembly 205 is held to the body 200 by a plurality of screws 240 which are inserted through holes in the outer frame 215 and inner gasket 210 and into the body 200. In the example of FIG. 2 multi-chamber ink tank 250 includes five chambers for different inks or other printing fluids, such as cyan, magenta, yellow, black for photo printing, and a clear protective fluid. Each chamber includes an outlet hole 230 that leads to an outlet port 300 (FIG. 3).

Figure 3:
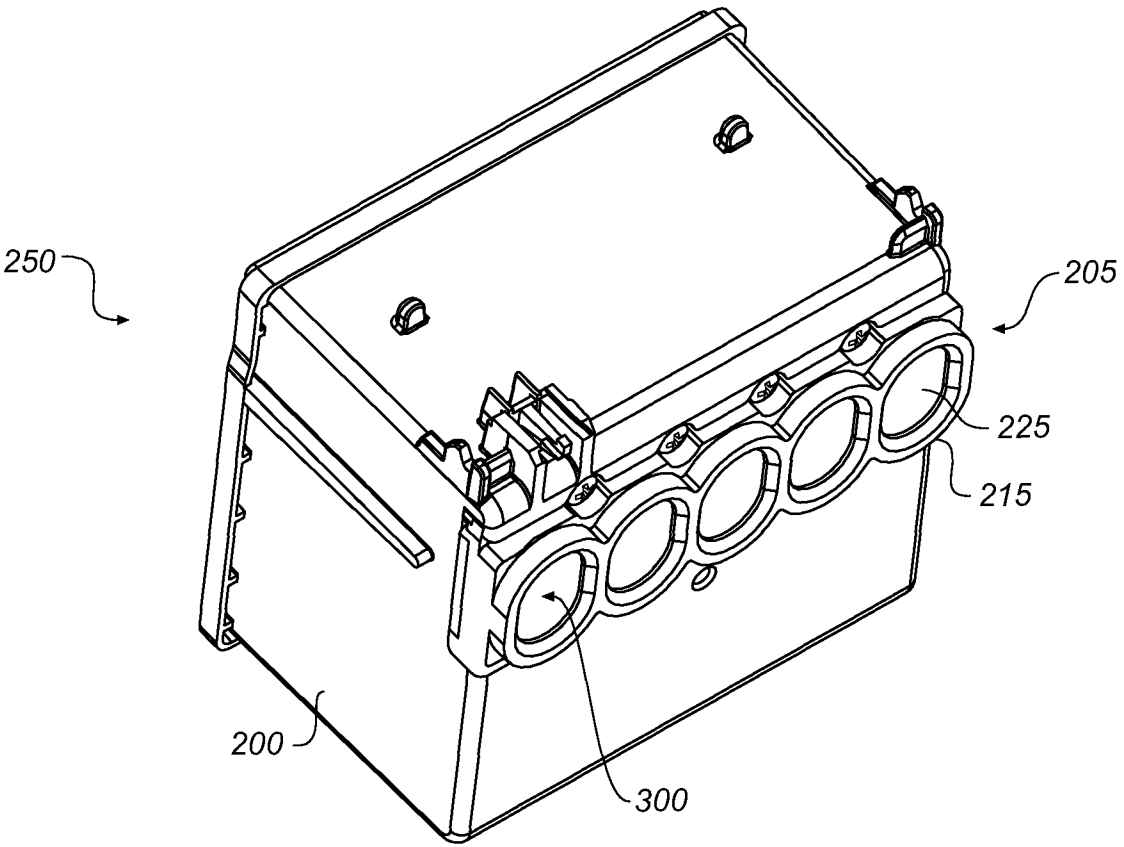
FIG. 3 is an assembled view of the multi-chamber ink tank of FIG. 2.

Referring to FIG. 3, there is shown the body 200 and flange assembly 205 attached to the body 200. A surface of each of the interface wicks 225 is exposed through its mated opening of the individual flange. One side of the compliant wick 220 is adjacent the interface wick 225 and is hidden from view when assembled as in FIG. 3, and the filter 235 is adjacent the other side of compliant wick 220 and is also hidden from view when assembled. Each outlet port 300 in this example includes an outlet hole 230, a filter 235, a compliant wick 220 an interface wick 225, an inner gasket unit 210*a* and an outer frame unit 215*a*.

Although a flange assembly 205 is shown as having several parts, the inner gasket 210 and the outer frame 215 can alternatively be made by other methods so as to be a one single unit as will be known by those skilled in the art.

Figure 4:
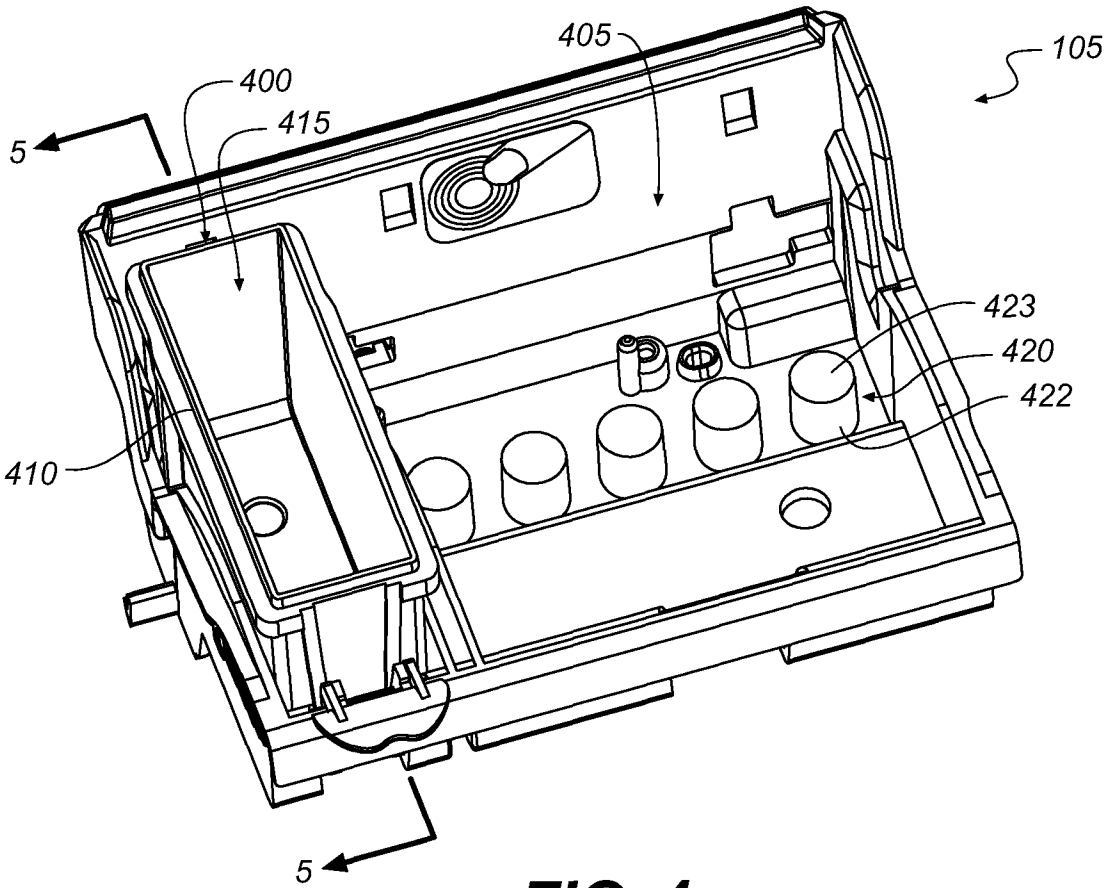
FIG. 4 is a top perspective of a printhead for use with the multi-chamber ink tank of FIG. 2.

Referring to FIG. 4, there is shown a top perspective of the printhead 105 having an interior portion divided into a single chamber ink tank holding receptacle 400 and a multi-chamber ink tank holding receptacle 405. A single chamber ink tank 410 for supplying black ink for text printing, for example, is shown disposed in the single chamber holding receptacle 400 and the cover of the single chamber ink tank 410 is removed so that a free ink reservoir 415 for retaining ink can be seen. A printhead 105 with at least one ink tank installed is sometimes called a printhead assembly herein. A pressure regulator 165 (FIG. 5) is not shown in FIG. 4, but can be of the type described in U.S. Pat. No. 5,719,609 for example. It is noted that the multi-chamber ink tank 250 (FIG. 3) is omitted from the multi-chamber ink tank holding receptacle 405 so that other portions of the printhead 105 can be seen more clearly. In this regard, the interior portion includes five inlet ports 420 in the multi-chamber ink tank holding receptacle 405 each having a printhead filter 423 covering an end of a standpipe 422. The five outlet ports 300 of the multi-chamber ink tank 250 (see FIGS. 2 and 3) are received by corresponding inlet ports 420. The interior portion on the single chamber ink tank holding receptacle 400 also includes an inlet port 420 but it is hidden from view in FIG. 4. The single chamber ink tank 410 is installed into the printhead 105 by pivoting the single chamber ink tank 410 downwardly and inwardly and latching a latch 425 (FIG. 5) of the printhead 105. The single chamber ink tank 410 can also be removed by releasing the latch 425 and pivoting the ink tank 410 outwardly and upwardly. The multi-chamber ink tank 250 (FIG. 3) is installed and removed in a similar fashion.

Figure 5:
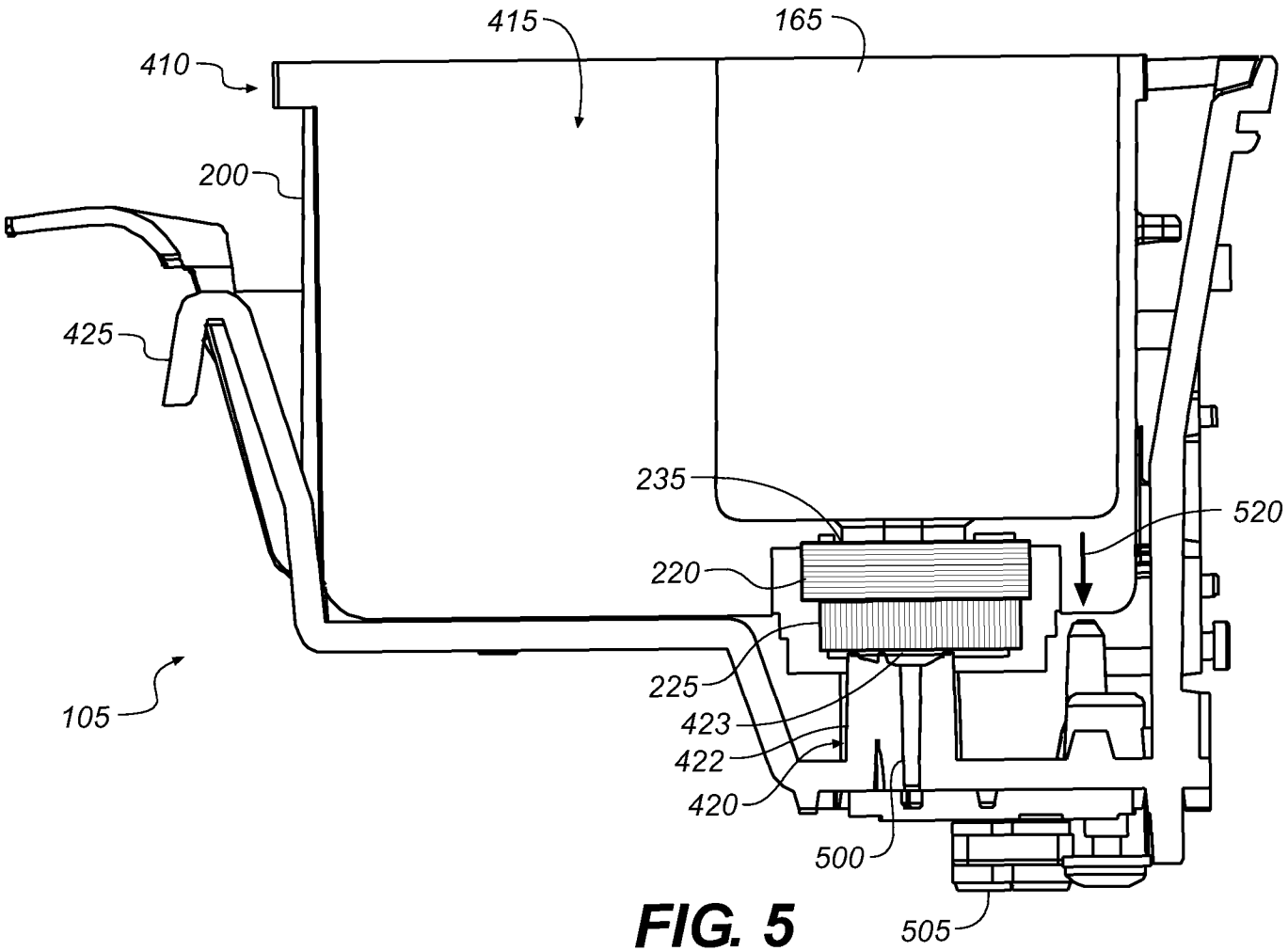
FIG. 5 is a cross-section through 5-5 of the printhead and single chamber ink tank of FIG. 4.

Referring to FIG. 5, there is shown a cross section through line 5-5 of FIG. 4 passing through single chamber ink tank 410. A cross section through a chamber of multi-chamber ink tank 250 (FIG. 3) mounted in printhead 105 would look similar to FIG. 5. The single chamber ink tank 410 includes the body 200 having a free ink reservoir 415 and a pressure regulator 165 for maintaining the pressure of the ink tank at or within a desired range for proper operation of the ink tank 410. It is noted that the compliant wick 220 is made of fibers that are perpendicular or substantially perpendicular to direction of ink flow from the ink tank 410 (see arrow 520) and the interface wick 225 includes fibers that are parallel or substantially parallel to the flow of the ink from the ink tank 410. The latching force of latch 425 holds the interface wick 225 in contact with the printhead filter 423 of inlet port 420 so that ink can be transferred to printhead 105 by capillary action. A hole 500 passes through a standpipe 422 of inlet port 420. Inlet port 420 is fluidically connected to nozzle array 505. Ink passes from the free ink reservoir 415 through filter 235, compliant wick 220, and interface wick 225 to the printhead filter 423 and hole 500 of inlet port 420 to the nozzle array 505 of the printhead 105. The standpipe 422 of inlet port 420 mates with an individual outlet port 300 for forming a seal to the ink tank 410.

The orientation of fibers in the compliant wick 220 substantially perpendicular to ink flow direction 520 permits transfer of ink while providing an ink tank insertion force at or below a predetermined force during an insertion process of the ink tank 410. Ink flow direction 520 is parallel to compression direction 260 (FIG. 2). The compliant wick 220 functions in a spring like manner so that, during insertion into printhead 105, the required force is not excessive so that the user inherently senses that installation is occurring correctly. The interface wick 225 has compliance that is less than the compliant wick 220 along the direction of ink flow 520 due to the fiber orientation being substantially parallel to the ink flow direction 520.

It is noted that the interface wick 225 can be omitted in some embodiments, so that only the compliant wick 220 transfers ink to the inlet port 300 of the printhead.

The invention has been described in detail with particular reference to certain preferred embodiments thereof, but it will be understood that variations and modifications can be effected within the spirit and scope of the invention.

PARTS LIST

100 off-axis printer
103 Eric
105 inkjet printhead
110 carriage
115 recording medium
120 primary ink supply
125 support base
130 print region
145 tubing connection
150 secondary ink supply
155 conduit
160 flexible tubing
165 pressure regulator
200 body
205 flange assembly
210 inner gasket
**210*a*** inner gasket unit
215 outer frame
**215*a*** outer frame unit
220 compliant wick
225 interface wick
230 holes
235 filter
237 perimeter
240 screws
250 multi-chamber ink tank
260 compression direction
300 outlet port
400 single chamber ink tank holding receptacle
405 multi-chamber ink tank holding receptacle
410 single chamber ink tank
415 free ink reservoir
420 inlet port
422 standpipe
423 printhead filter
425 latch
500 hole
505 nozzle array
520 arrow (ink flow direction)

The invention claimed is:

1. An ink tank comprising:

a body for retaining ink which body includes an outlet hole for permitting ink to pass from the reservoir body;

a flange portion surrounding the outlet hole;

a filter affixed to a periphery of the outlet hole; and at least a first wick positioned in the flange portion and having fibers that are oriented in a direction perpendicular or substantially perpendicular to ink flow out of the outlet hole which permits transfer of ink while providing compliance during an insertion process of the ink tank; wherein the filter is positioned upstream of the wick;

a second wick positioned in the flange portion and having compliance that is less than that of the first wick, wherein a first side of the first wick is positioned adjacent the filter, and the second wick is positioned adjacent a second side of the first wick.

2. The ink tank as in claim 1, wherein fibers of the second wick are oriented in a direction parallel or substantially parallel to ink flow out of the outlet hole.

3. The ink tank as in claim 1, wherein the flange includes a first portion shaped in conformity with the first wick.

4. The ink tank as in claim 1, wherein the flange includes a second portion shaped in conformity with the second wick.

5. The ink tank as in claim 1, wherein the first wick has a rectangular shape.

6. The ink tank as in claim 1, wherein the second wick has round ends.

7. A printhead assembly comprising:

a nozzle array;

an inlet port fluidically connected to the nozzle array; and all ink tank comprising:

a body for retaining ink which body includes an outlet hole for permitting ink to pass from the reservoir body;

a flange portion surrounding the outlet hole; a filter affixed to a periphery of the outlet hole; and a first wick positioned in the flange portion and having fibers that are oriented in a direction perpendicular or substantially perpendicular to ink flow out of the outlet hole which permits transfer of ink while providing compliance during an insertion process of the ink tank; wherein the filter is positioned upstream of the wick;

a second wick positioned in the flange portion and having a compliance that is less than that of the first wick, wherein the second wick is pressed into contact with the inlet port of the printhead.

8. A printer comprising:

a carriage;

a printhead assembly mounted in the carriage, the printhead comprising:

a nozzle array;

an inlet port fluidically connected to the nozzle array; and an ink tank comprising:

a body for retaining ink which body includes an outlet hole for permitting ink to pass from the reservoir body;

a flange portion surrounding the outlet hole;

a filter affixed to a periphery of the outlet hole; and a first wick positioned in the flange portion and having fibers that are oriented in a direction perpendicular or substantially perpendicular to ink flow out of the outlet hole which permits transfer of ink while providing compliance during an installation process of the ink tank; wherein the filer is positioned upstream of the wick;

a second wick positioned in the flange portion and having a compliance that is less than that of the first wick, wherein the second wick is pressed into contact with the inlet port of the printhead.

9. The printer as in claim 8 further comprising:

a primary ink supply; and flexible tubing connecting the primary ink supply and the ink tank.

* * * * *